US005623954A

United States Patent [19]

Cefis

[11] Patent Number: 5,623,954

[45] **Date of Patent: *Apr. 29, 1997**

[54] HAIR ANCHORING DEVICE

[75] Inventor: Adolfo Cefis, Milan, Italy

[73] Assignee: Arborea S.A.S. di Adolfo Cefis & C., Milan, Italy

[ * ] Notice: The term of this patent shall not extend beyond the expiration date of Pat. No. 5,511,567.

[21] Appl. No.: 558,239

[22] Filed: Nov. 17, 1995

Related U.S. Application Data

[63] Continuation of Ser. No. 230,751, Apr. 21, 1994, Pat. No. 5,511,567.

[51] Int. Cl.[6] ..... A45D 8/30

[52] U.S. Cl. ..... 132/279; 132/273; 132/145; 24/456

[58] Field of Search ..... 132/273, 275, 132/278, 279, 53, 54, 144, 145, 101, 281, 129, 130, 131; 24/456; D28/39, 40, 41, 42, 43

[56] References Cited

U.S. PATENT DOCUMENTS

| | | | |
|---|---|---|---|
| 62,606 | 5/1867 | Cassidy | 132/145 |
| 89,212 | 4/1869 | Gallup | 132/130 |
| 284,341 | 9/1883 | Thorpe | 132/275 |
| 1,775,209 | 9/1930 | Oppenheim | 132/130 |
| 2,393,376 | 1/1946 | Holden | 132/275 |

*Primary Examiner*—Todd E. Manahan

*Attorney, Agent, or Firm*—Colucci & Umans

[57] ABSTRACT

A hair anchoring and decorating device comprises a receiving section locatable in an area of hair. The receiving section is a clamp ring made of a resilient material. A plurality of comb assemblies comprising an arcuate comb having a plurality of teeth are arranged around a central wheel having a geared outer circumference. At least a portion of each comb assembly is geared for interlocking with the gears of the central wheel for providing rotational movement of the combs and teeth. The teeth are movable in a receiving space of the clamp ring for securing a gathering of hair between the teeth of each comb. A positioning tool is engageable with the central wheel and comb assemblies for effectuating rotation thereof.

9 Claims, 5 Drawing Sheets

HAIR ANCHORING DEVICE

This application is a continuation of application Ser. No. 08/230,751, filed Apr. 21, 1994, now U.S. Pat. No. 5,511, 567.

FIELD AND BACKGROUND OF THE INVENTION

The present invention relates, in general, to hair engaging devices, and in particular to, a new and useful device for anchoring an ornamental or other piece such as a jewel, for example, into hair, for display or for other reasons.

U.S. Pat. No. 3,669,129 discloses a wiglet attaching device comprising a collar which is fitted around a matted nest of hair and is held in place on the head by combs having teeth which are inserted into holes in the collar. The wig is, in turn, secured to the collar.

U.S. Pat. No. 2,977,960 discloses a permanent wave device comprising two C-shaped plates having a plurality of teeth at a curved inner edge. The plates are movably connected to each other by a rivet; and a pin member engages each clamp for clamping hair strands between the teeth of the clamp.

U.S. Pat. No. 2,445,071 discloses a hair dressing ring comprising two pairs of comb teeth positioned opposite each other. The ring has a tongue at its outer circumference for opening and closing the ring. Upon gathering a crop of hair, the ring is inserted around the crop and locked by the tongue mechanism such that the teeth interlock with each other securing the hair therebetween.

U.S. Pat. No. 2,159,709 discloses a hair clasp which utilizes oppositely positioned teeth at its inner circumference and a pair of C-shaped hooks to latch and unlatch the clasp around a gathering of hair.

Presently, there is no known device for firmly and securely anchoring a piece, such as an ornamental display piece, to the hair, in an efficient manner, while at the same time allowing the ornamental piece to be easily removed.

SUMMARY OF THE INVENTION

The present invention pertains to attaching a piece, such as an ornamental or functional piece, to any type of hair, e.g. human or pet hair, head hair, chest hair, etc.

In its broadest sense, the present invention is a device for removably anchoring a piece to hair, comprising: miniature clamp means having an open position for receiving a tuft of hair and a closed position for firmly clamping the tuft of hair; mounting means for carrying a piece, the mounting means being connected to the miniature clamp means and usually in a position for viewing the piece carried by the mounting means, when the miniature clamp means is in the closed position firmly clamping the tuft of hair; and activating means operatively connected to the miniature clamp means for moving the miniature clamp means to the open position for receiving and releasing a tuft of hair, and into the closed position for firmly clamping a tuft of hair received in the miniature clamp means in its open position.

An example of the invention is a device comprising a receiving section locatable in an area of hair wherein the receiving section is a clamp ring having a receiving space and made of a resilient material. A plurality of comb assemblies are around the clamp ring, each comprising a circular housing connected to an arcuate comb having a plurality of teeth wherein. Each assembly is arranged around a central wheel having a geared outer circumference. At least a portion of each comb assembly housing is geared for interlocking with the gear of the central wheel which provides rotational movement for the combs and teeth. The combs are movable in the receiving space of the clamp ring for securing a gathering or tuft of hair, between the teeth of each comb.

A base plate is secured to the clamp ring and has a central hub on its upper surface for receiving the central wheel. A top cover having a plurality of holes arranged in direct alignment with the central wheel and each comb assembly is fitted over the central wheel and comb assemblies and is connected to the base plate by a plurality of pins.

A central spring is connected to the central wheel and the base plate; and a tool or implement having a tip or operating end, is engageable with the comb assemblies and the central wheel for rotating the combs into open and closed positions, within the clamping ring.

A cover plate is detachably engageable with the top cover for holding a piece, for example, for displaying an ornament such as a jewel or jewelry piece, and for keeping the device locked in position.

Other examples of the miniature clamp means are included within the scope of the present invention. For example, rather than using rotatable combs, movable ribbons can be arranged circumferentially around a central hub and rotated between an open position for receiving hair in spaces defined by the ribbons, and to a closed position where the spaces are closed to firmly clamp the hair in the now closed spaces.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which an embodiment of the invention is illustrated.

DESCRIPTION OF THE PREFERRED EMBODIMENTS

Figure 2:
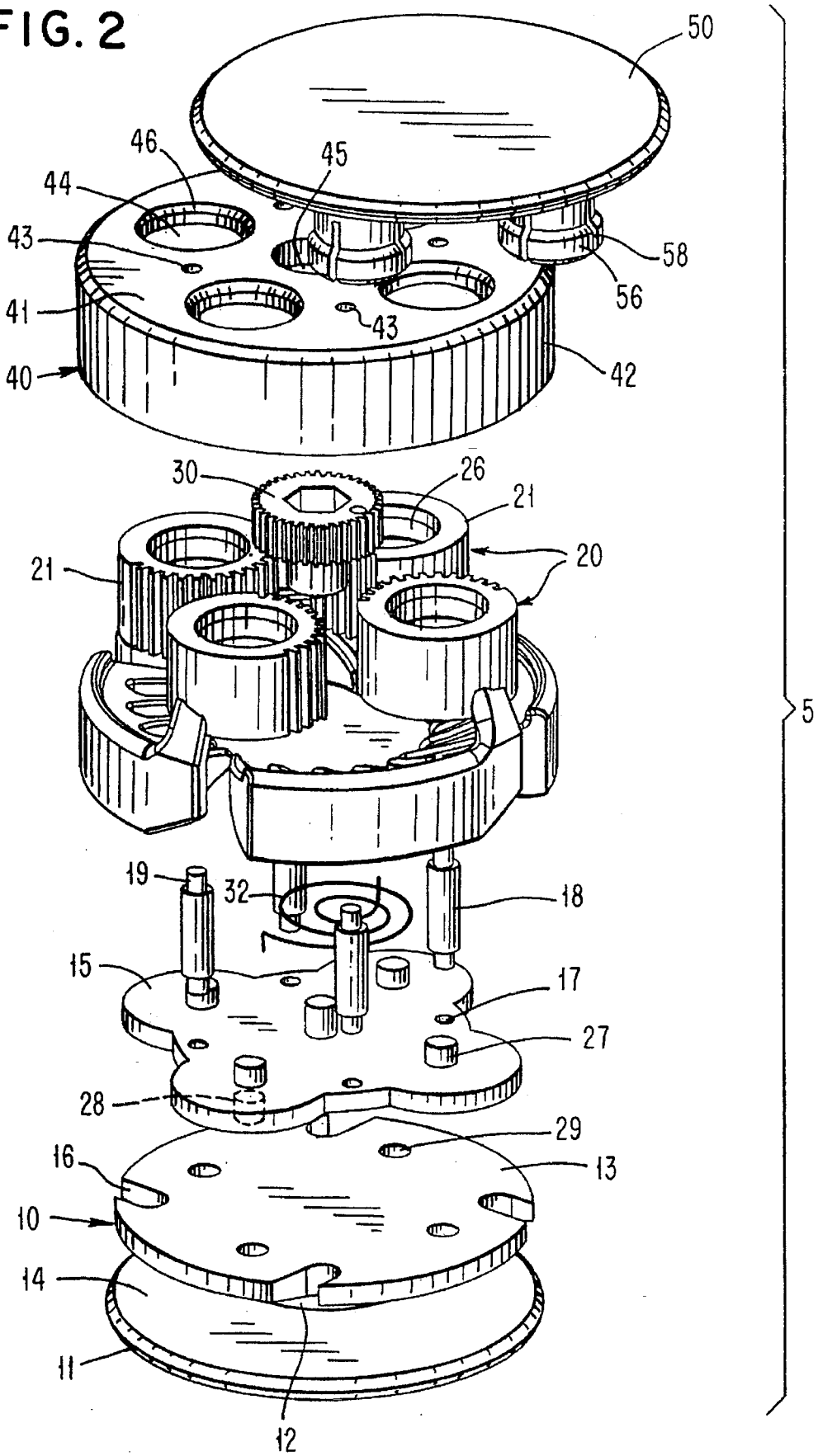
FIG. 2 is an exploded perspective view of the present invention.
Figure 6:
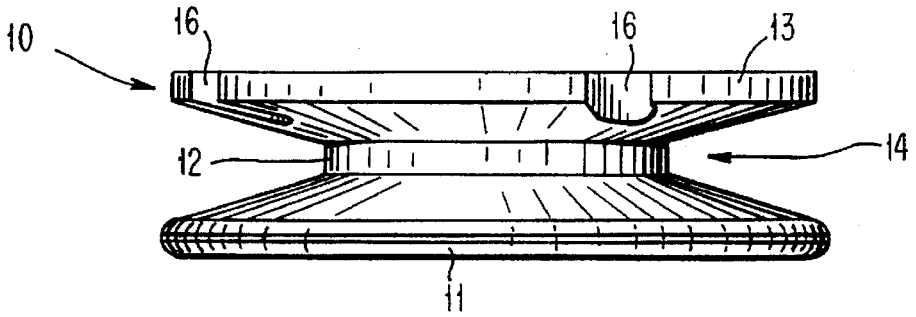
FIG. 6 is a side view of a clamp ring of FIG. 1.

As illustrated in FIG. 2, the present invention is a hair anchoring device, in particular for removably fixing an item or piece, e.g. a jewel to hair, comprising a receiving section or clamp ring generally designated 10, having a bottom portion 11 connected to a center section 12 and a top portion 13 connected the center section 12. The top portion 13 and bottom portion 11 each have a diameter which is greater than the center section 12 so that a space or recess 14 is provided between the top section 13 and the bottom section 11, as best shown in FIG. 6. FIGS. 2 and 6 also illustrate a plurality of cuts 16 in the top portion 13 of the ring clamp 10.

The ring clamp 10 is made of resilient material such as rubber or other high friction, elastic material, and is placed onto a skin surface bearing hair.

Figure 1:
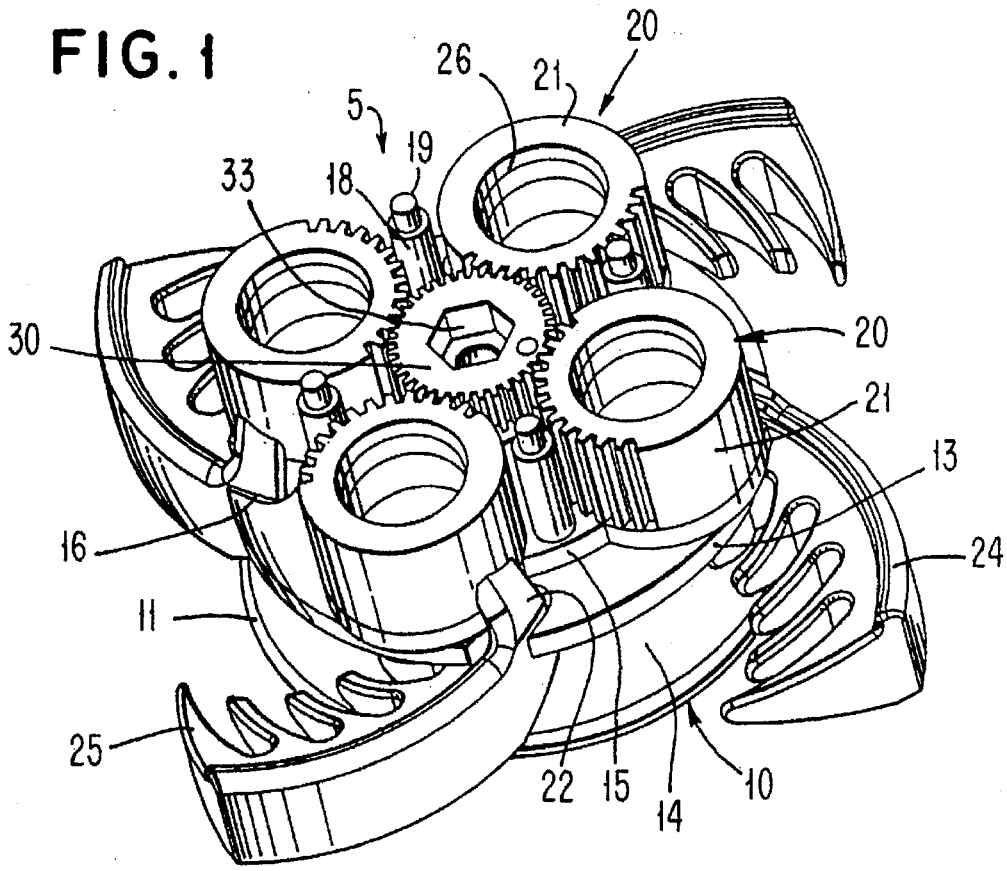
FIG. 1 is a perspective view of a plurality of comb assemblies in a open position according to the present invention.
Figure 5:
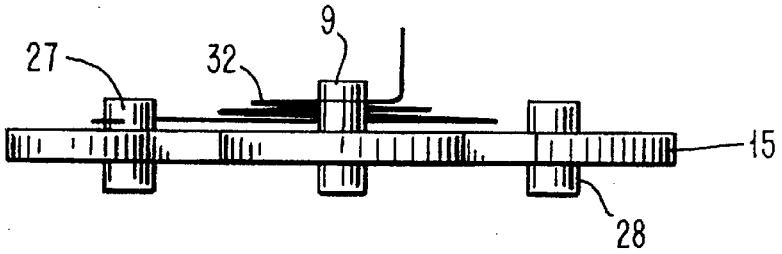
FIG. 5 is a side view of a base plate of FIG. 2.

Turning to FIGS. 1, 2 and 5, a base plate 15 is mounted to the top portion 13 of the clamp ring 10. Base plate 15 is metal and has connection means such as posts 28 in FIG. 5 used to connect the base plate 15 to the ring clamp 10. To this end, posts 28 are press-fit into holes 29 in clamp 10. Clamp 10 may also be glued to base plate 15, e.g. with self-sticking adhesive glue. The base plate 15 has four upper posts 27 mounted on its top surface and a centrally positioned central hub 9 also extending from the top surface. Holes 17 are located between the upper posts 27 as shown in FIG. 2. FIG. 5 also schematically shows a spring 32 connected to the base plate 15 at its upper end, around the central hub 9. Spring 32, in practice, may be any appropriate shape or style spring, e.g. a strong coil spring made of spring ribbon such as that used in a wind-up clock or the like.

Figure 3:
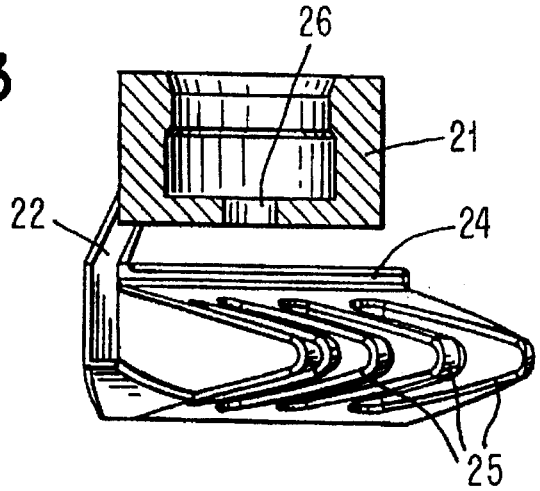
FIG. 3 is a partial sectional view of a comb assembly of the invention.

Four comb assemblies generally designated 20, each comprising a circular housing 21 having a hole 26 therethrough and an extension arm 22 downwardly extending from the housing 21 as shown in FIGS. 2 and 3, are arranged in a circle as shown in FIGS. 1 and 2.

Figure 4:
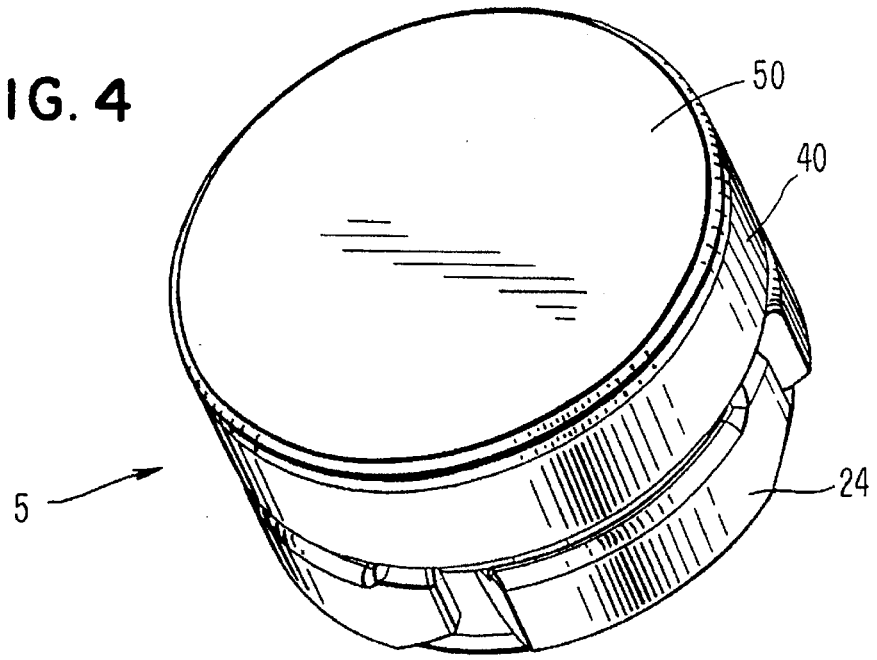
FIG. 4 is a perspective view of the present invention in a closed position.
Figure 8:
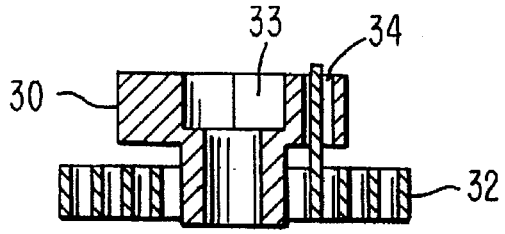
FIG. 8 is a sectional view of FIG. 7 taken along line 8—8.

As shown in FIGS. 4 and 8, a central wheel 30 has a central hole 33 bored therethrough, and is rotatably mounted to the central hub 9 of the base plate 15 (FIG. 5) which permits rotational movement of the central wheel 30 about the central hub 9. The central wheel 30 also has a second hole 34 for receiving an end of spring 32. Spring 32 is connected at one end to the central wheel 30 at hole 34 and coiled around a stem portion of the central wheel 30 and is connected at its opposite end to the base plate 15, for example, in a hole in plate 15.

Figure 7:
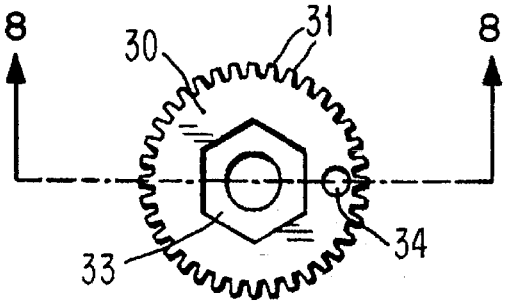
FIG. 7 is a top view of a central wheel of FIG. 1.

The central wheel 30 has a geared outer periphery 31 extending around the entire circumference of the wheel 30 as shown in FIG. 7. The central hole 33 in wheel 30 has a hexagonal periphery which steps down to a circular shape so that wheel 30 can rotate on hub 9, as shown in FIG. 8.

Four comb assemblies 20 are positioned around the central wheel 30 as shown in FIG. 1. The holes 26 of the comb assemblies 20 are seated over upper posts 27 of the base plate 15 (FIG. 5). The circular housing 21 of the comb assembly 20 has a geared surface 23 over a portion of its outer periphery or circumference for engagement with the gears of the central wheel 30.

As illustrated in FIG. 3, the circular housing 21 with the downwardly extending arm 22 has an arcuate comb 24 having a plurality of spaced teeth 25 extending therefrom. The comb assemblies 20 are arranged about the central wheel 30 such that the geared portion 23 of each comb assembly 20 is engaged to the geared section 31 of the wheel 30 and the arcuate combs and teeth point inwardly toward the axis of the central wheel 30. As shown in FIG. 1, the arms 22 of each comb assembly 20 are seated within areas 16 of the top portion 14 of the clamp ring 10. The arcuate combs 24 and teeth 25 are received within the space or recess 14 of the clamp ring 10 when the clamp is closed, and are movable out of space 14, when it is open.

A top cover 40 comprising a cylindrical housing 42, is fitted over the central wheel 30 and comb assemblies 20. FIG. 2 shows the top cover 40 having four holes 44 and a central hole 45 through its upper surface. Pin holes 43 are arranged between each circular hole 44. Holes 44 also have an outer inclined periphery 46 having a diameter greater than the diameter of holes 44.

The top cover is fitted over the central wheel 30 and comb assemblies 20 such that holes 44 are in direct alignment with the holes 26 of each comb assembly 20 and the central hole 45 is aligned directly with the hole 33 of the central wheel 30.

FIG. 2 illustrates four pins 18 used to connect the base plate 15 and ring clamp 10 to the top cover 40. Pins 18 have small diameter ends 19 wherein one end 19 is inserted into pin hole 17 on the base plate 15 and its opposite end inserted into the pin hole 43 of the top cover 40.

Figure 11:
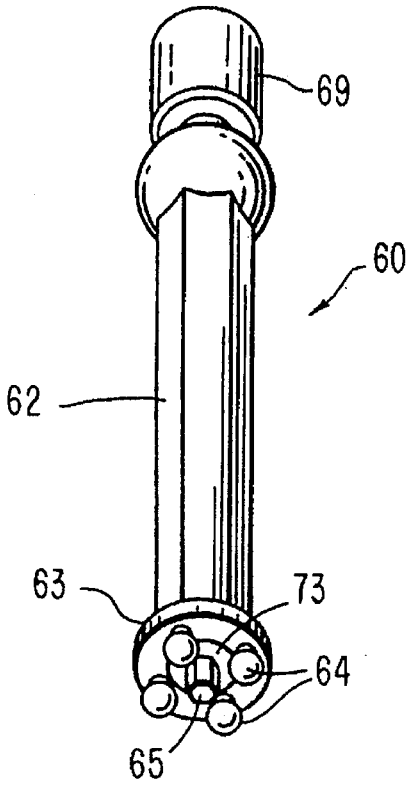
FIG. 11 is a perspective view of a positioning tool used in conjunction with the device of FIG. 2.
Figure 12:
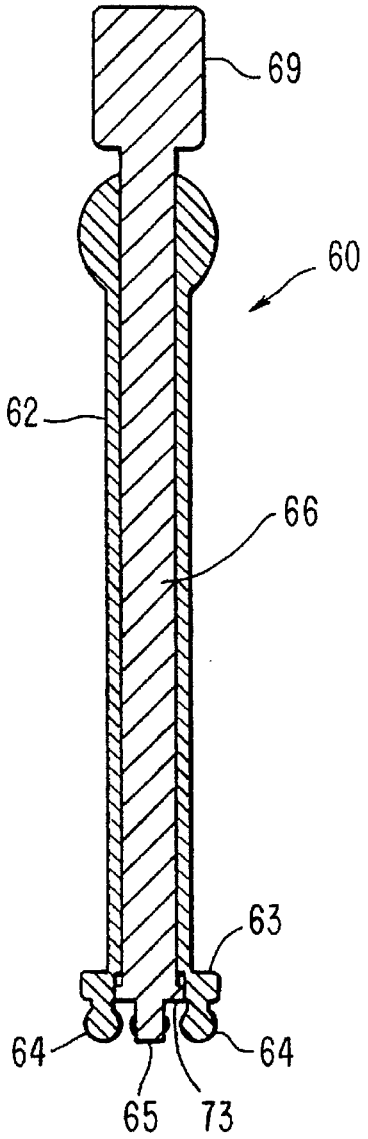
FIG. 12 is a view in cross-section, of the positioning tool of FIG. 11.

A positioning tool 60, as shown in FIGS. 11 and 12, includes an outer shaft 62 having an outer circular tip 63 mounted at one end. An inner shaft 66 is located within outer shaft 62 and is rotatable and axially movable therein. A center extension 65 extends from the bottom surface of an inner circular tip 73 of the inner shaft 66 and is surrounded by four spherical extensions 64 which extend from the bottom surface of circular tip 63 of outer shaft 62. The center extension 65 and the spherical extensions 64 are shaped to be fitted within the central wheel 30 and the comb assemblies 20 respectively, i.e. to be received within hole 26 of the comb assembly 20 and hole 33 of the central wheel 30. The inner shaft 66 is rotatable in a clockwise and counterclockwise direction for effectuating the rotation of the central wheel 30 and comb assemblies 20 when extensions 64 and 65 are mated with holes 26 and 33, respectively.

The anchoring device generally designated 5, is anchored to a surface bearing a tuft of hair, by inserting the circular extension 64 and the central extension 65 of the positioning tool 60 through the peripheral holes 44 and the central hole 45 of the top cover 40 and into the holes 26 of the comb assemblies 20 and the hole 3 of the central wheel 30 to hold the device 5 in place.

The device is then positioned at the clamp ring 10 at or near the surface of skin bearing the tuft of hair. This can be done with the arcuate combs 24 in an open or closed position depending on the user. This will be described in greater detail below. It is preferable, however, to maintain the combs 24 in a closed position with respect to the clamping ring 10 for achieving a positioning close to the skin surface if desired. For some types of hair, e.g. head hair, it may not be necessary to position the clamp ring close to the skin.

A gentle turning of the shaft 66 between the fingers of the user in both a clockwise and counterclockwise movement, provides for a sufficient digging or driving of the clamping ring 10 toward the skin surface as desired. The combined clockwise and counterclockwise rotation of the shaft 66 assists in driving the clamp ring 10 through the hair and also provides a positioning of the clamp ring 10 at or very near the skin surface if so desired.

When a desired depth within the hair is achieved, the inner shaft 66 of handle 60 must first be rotated, by turning knob 69 at the top of inner shaft 66, in a direction such that the combs 24 are withdrawn from the center section 12 within the space 14 of the clamp ring 10 and then moved toward the space 14, thereby gathering the tuft of hair and trapping it between the teeth 25 of each comb 24, and the high-friction ring 10.

Spring 32 biases the center wheel 30 in a closing position, i.e. the center wheel 30 keeps the four comb assemblies 20 in a closed position by providing force against the geared portions 23 of the circular housing 21 of each comb assembly 20. When the center wheel 30 is rotated in a clockwise direction by the positioning tool 60, the resistance of the spring 32 is overcome which causes the comb assemblies 20 to rotate in a counterclockwise direction, which in turn, causes each comb 24 to be moved away from the clamping ring 10, i.e. withdrawn from space 14 into an open position as illustrated in FIG. 1. As soon as the force is released, i.e. by releasing knob 69, spring 32 exhibits a counterforce which rotates the center wheel 30 to its original position which consequently moves the comb assemblies 20 and their respective combs 24 toward the closed position.

When center extension 65 is engaged with hole 33 of the center wheel 30, the resistance of spring 32 is overcome by turning knob 69 clockwise and consequently inner shaft 66 and center extension 65 also turn clockwise, thus causing the combs 24 to rotate counterclockwise, or into the open position. Upon releasing knob 69, the spring 32 forces the center wheel 30 to rotate in the counterclockwise direction, which in turn, causes the comb assemblies 22 to rotate in the clockwise direction which causes the combs 24 with teeth 25 to gather hair between the teeth 25 and draw the hair toward the clamping ring 10 as the combs 24 are moved to their closed position. If necessary, the spring's effect may be helped by rotating knob 69, counterclockwise (thus rotating shaft 66 and extension 65 in the same direction) which will cause the center wheel to rotate counterclockwise also. Thus, the gathered hairs are held between teeth 25 and trapped between the combs 24 and the clamp ring 10 which provides an efficient anchoring for the device 5.

After closing the device, the circular extensions 64 are withdrawn from the holes 26 of the comb assemblies 20 and the central extension 65 is withdrawn from hole 33; and removed from the device 5 through holes 44 and 45 of the top cover 40.

Figure 13:
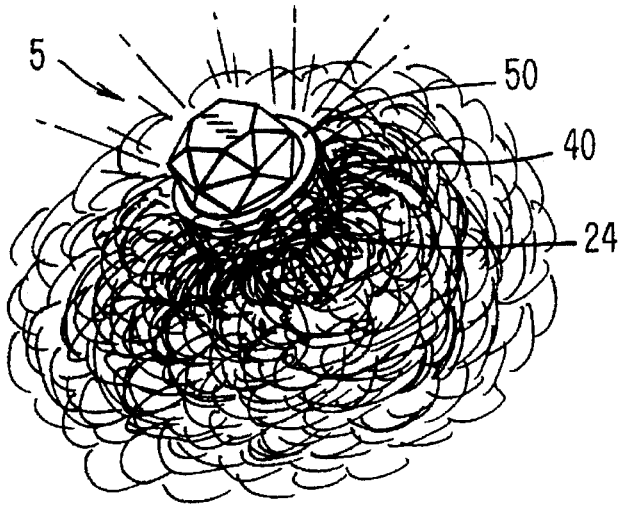
FIG. 13 is a view of the anchoring device holding a jewel to the hair.

After the device 5 has been anchored into the hair, a plate 50 having a top platform 52, which is ornamental or can carry an ornament piece like a jewel, is mounted to the device 5 at the top cover 40 as illustrated in FIGS. 4 and 13. The upper surface of the top platform 52 can be adorned by a jewelry piece, jewel or can be decorated, preferably, by engraving, enameling or coating the upper surface 52.

Plate 50 may also be used to hold another piece or structure to be held to the hair.

Figure 9:
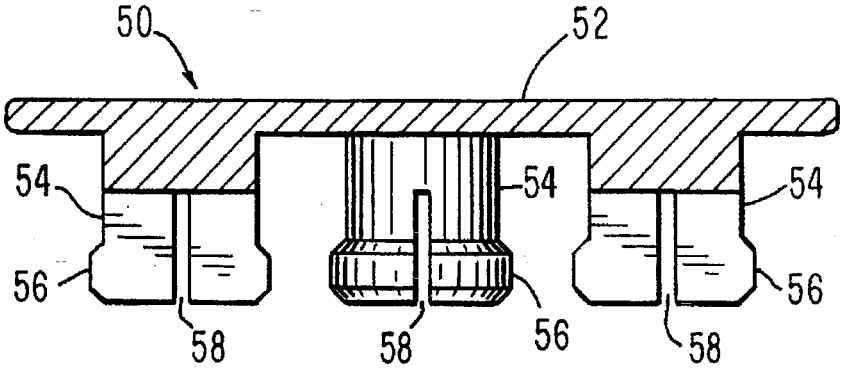
FIG. 9 is a sectional view of an item plate.
Figure 10:
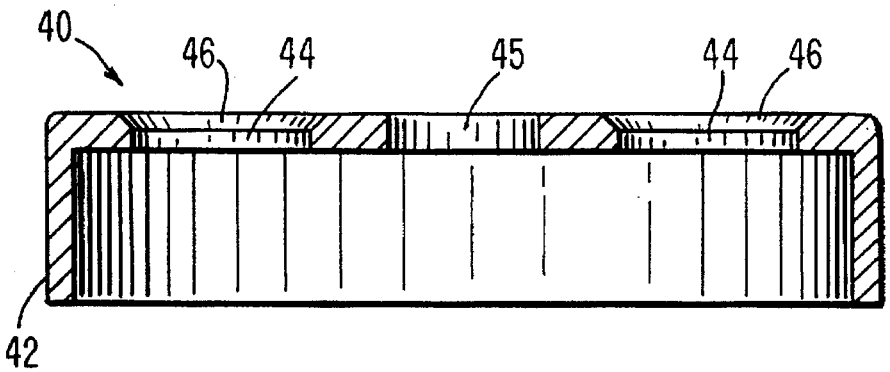
FIG. 10 is a sectional view of a cover.

Platform 52 has four downwardly extending cylindrical legs 54 arranged beneath the upper surface 52 which correspond to the four holes 44 of the top case 40 as shown in FIG. 9. Each cylindrical leg 54 has a resilient tip 56. When securing the plate e.g. used as a jewel plate 50, to the device 5 at the top cover 40, the cylindrical legs 54 are positioned in direct alignment with the holes 44 of the top cover and are inserted therethrough. By applying a slight pressure, the cylindrical legs 54 and tips 56 are secured within the cylindrical openings 26 of the comb assemblies 20 in snap-lock fashion because of the direct alignment of the holes 26 of comb assemblies 20 with holes 44 of the top cover 40. While locking tips 56 of cylindrical legs 54 of the jewel plate 50 into the cylindrical holes 26 of the comb assemblies 20, any movement of the comb assemblies 20 is thereby prevented and the combs 24 of the assemblies 20 are locked in place, such as the closed position, as shown in FIGS. 4 and 13. The combs 24 are tightly held due to the combined action of the central spring 32 acting on central wheel 30 and the tips 56 of the jewel plate 50.

As shown in FIG. 9, each cylindrical leg 54 of the jewel plate 50 is provided with a plurality of cuts 58 which longitudinally extend from the tip 56 through a substantial portion of the leg 54. Two cuts 58 are provided transverse to each other. Cuts 58 in the legs 54 facilitate removal of the jewel plate 50 from the device 5 because any pulling (pushing) force on the jewel plate 5 causes the tips 56 and legs 54 of the jewel plate 50 to have their circumference substantially reduced by being compressed inwardly toward the center of each leg 54 as the legs 54 are withdrawn from (or inserted into) the circular holes 26 of the comb assemblies 20 and the circular holes 44 of the top cover 40.

Once the jewel plate 50 is removed from the device 5, the device 5 can be removed from the hair as follows. The positioning element 60 (FIGS. 11 and 12) is reinserted through the top cover 40 at holes 44 and 45 such that the central extension 65 of the central tip 73 of inner shaft 66 is inserted into the central opening 33 of the central wheel 30 and the circular extensions 64 of the outer circular tip 63 of the outer cylinder 62 are inserted into the circular openings 26 of the comb assemblies 20. While maintaining the outer shaft 62 in a steady position, the user uses his or her other hand to grasp the rotation knob 69 between two fingers, i.e. the thumb and forefinger, and rotates the cylinder 69 in a clockwise direction. This rotational movement overcomes the resistance of spring 32 and turns the center wheel 30 in a clockwise direction.

Accordingly, the comb assemblies 20 with associated combs 24 rotate counterclockwise and are drawn away from the clamp ring 10 until the combs 24 are in an open position and have released the hair which was trapped against the clamp ring 10. Sufficient force must be applied to the inner shaft 66 for axially compressing the spring 32 in order to overcome the resistance of spring 32 and maintain the combs 24 in the open position as shown in FIG. 1.

The device 5 is then gently removed from the hair by letting the hair between teeth 25 of each comb 24 slide gently therethrough without causing a pulling or breaking of the hairs. When the device 5 is completely removed from the hair and the combs 24 of the comb assemblies 20 are freed of any hair, the rotation cylinder 69 is released from between the thumb and forefinger of the user such that the spring 32 pushes the center wheel 30 in a counterclockwise direction bringing the device 5 to the original closed position as the positioning tool 60 is removed from the device 5.

While a specific embodiment of the invention has been shown and described in detail to illustrate the application of the principles of the invention, it will be understood that the invention may be embodied otherwise without departing from such principles.

What is claimed is:

1. A device for removably anchoring an item to hair, comprising:

a miniature central receiving section locatable in an area containing hair;

a plurality of comb assemblies pivotally connected to the central receiving section and spaced symmetrically around the central receiving section, each comb assembly having a plurality of teeth and each assembly being pivotable in the same pivot direction, between an open position with the teeth spaced away from the central receiving section, and a closed position with the teeth moved radially inwardly into engagement with the central receiving section for trapping hair between the comb assemblies and the central receiving section; and mounting means connected to the central receiving section for connecting an item to the central receiving section for anchoring the item to the hair;

the central receiving section including an annular groove there around, the teeth of the comb assemblies being shaped to be engageable into the annular groove when the comb assemblies are in their closed positions.

2. A device according to claim 1, wherein the comb assemblies each have combs with teeth in a common radial plane.

3. A device according to claim 1, wherein including gear means for moving the comb assemblies between their open and closed positions.

4. A device according to claim 1, wherein each comb assembly includes a curved comb portion and a gear portion, the device including a rotatable central gear meshed with the gear portions of each comb assembly so that rotation of the central gear causes movement of the comb assemblies between the closed and opens positions, and a central receiving section against which the teeth of the comb assemblies are engagable with the comb assemblies in their closed positions.

5. A device for removably anchoring an item to hair, comprising:

a miniature central receiving section locatable in an area containing hair;

a plurality of comb assemblies pivotally connected to the central receiving section and spaced symmetrically around the central receiving section, each comb assembly having a plurality of teeth and each assembly being pivotable in the same pivot direction, between an open position with the teeth spaced away from the central receiving section, and a closed position with the teeth moved radially inwardly into engagement with the central receiving section for trapping hair between the comb assemblies and the central receiving section, each comb assembly comprising a gear portion and a curved comb portion; and mounting means connected to the central recdiving section for connecting an item to the central receiving section for anchoring the item to the hair.

6. A device according to claim 5, including a central gear meshed with the gear portion of each comb assembly and means for rotating the central gear for moving the comb assemblies between their open and closed positions.

7. A device according to claim 6, including spring means for biasing the central gear and gear portions to rotate in a direction for moving the comb assemblies into their closed position.

8. A device according to claim 5, wherein the receiving section includes an annular groove therearound for receiving the teeth of the comb assemblies.

9. An arrangement for removably anchoring an item to hair, comprising:

miniature clamp means having an open position for receiving a tuft of hair, and a closed position for firmly clamping the tuft of hair;

mounting means for connection to the item, the mounting means being connected to the miniature clamp means when the miniature clamp means is in the closed position firmly clamping a tuft of hair;

activating means operatively connected to the miniature clamp means for moving the miniature clamp means to the open position for receiving and releasing a tuft of hair, and into the closed position for firmly clamping tuft of hair which was received in the miniature clamp means when it was in its open position; and a separate tool engageable with the activating means for operating the activatable means to move the miniature clamp means between the open and closed positions.

* * * * *